US005641935A

United States Patent [19]

Hunter et al.

[11] Patent Number: 5,641,935

[45] Date of Patent: Jun. 24, 1997

[54] ELECTRONIC SWITCH FOR TRIGGERING FIRING OF MUNITIONS

[75] Inventors: Donald W. Hunter; Andrew M. Leshchyshyn, both of Silver Spring, Md.

[73] Assignee: The United States of America as represented by the Secretary of the Army, Washington, D.C.

[21] Appl. No.: 515,612

[22] Filed: Aug. 16, 1995

[51] Int. Cl.[6] ..... F42C 11/00

[52] U.S. Cl. ..... 102/206; 102/218

[58] Field of Search ..... 102/218, 202.8, 102/202.7, 219, 206, 202.5, 220, 215

[56] References Cited

U.S. PATENT DOCUMENTS

| | | | |
|---|---|---|---|
| 2,314,361 | 4/1943 | Olson et al. | 102/218 |
| 2,623,921 | 12/1952 | Smits | 102/218 |
| 2,996,991 | 8/1961 | Menzel | 102/218 |
| 3,245,353 | 4/1966 | Gilbertson et al. | 102/218 |
| 3,255,366 | 6/1966 | McNulty et al. | 102/218 |
| 3,288,068 | 11/1966 | Jefferson et al. | 102/218 |
| 3,757,697 | 9/1973 | Phinney | 102/218 |
| 4,559,875 | 12/1985 | Marshall | 102/218 |
| 5,080,016 | 1/1992 | Osher | 102/202.7 |

FOREIGN PATENT DOCUMENTS

| | | | |
|---|---|---|---|
| 1298114 | 5/1962 | France | 102/219 |
| 1073365 | 1/1960 | Germany | 102/206 |
| 1129409 | 5/1962 | Germany | 102/219 |

*Primary Examiner*—Michael J. Carone
*Assistant Examiner*—Christopher K. Montgomery
*Attorney, Agent, or Firm*—Freda L. Krosnick; William E. Eschelman

[57] ABSTRACT

An electronic switch for triggering firing of munitions, the switch including an electrical circuit having a high voltage source, a sealed two electrode gap in communication with the high voltage source, a microgap in series with the sealed gap, an exploding foil initiator in communication with the microgap, and an energy storage capacitor bridging legs of the circuit between the high voltage source and the sealed gap. A trigger circuit is in communication with the high voltage source and a fire pulse generator, and is provided with a lead extending from the trigger circuit to one of said legs of said circuit between said sealed gap and said microgap. The energy storage capacitor is charged by the high voltage source to a voltage V which is substantially across the sealed gap. A pulse from the fire pulse generator activates the trigger circuit to provide a high voltage potential $V_t$ across the sealed gap, such that voltage $V+V_t$ breaks down the sealed gap to permit conduction therethrough. The microgap is thereby made subject to the pulse high voltage $V_t$ and the conduction under voltage V through the sealed gap, breaking down the microgap to permit flow of current to the exploding foil initiator.

11 Claims, 2 Drawing Sheets

ELECTRONIC SWITCH FOR TRIGGERING FIRING OF MUNITIONS

STATEMENT OF GOVERNMENT INTEREST

The invention described herein may be manufactured, used and licensed by or for the Government for Governmental purposes without the payment to us of any royalty thereon.

BACKGROUND OF THE INVENTION

1. Field of the Invention

The invention relates to switches for triggering firing of munitions, rockets, and the like, and is directed more particularly to a high voltage electronic switch for controlling the discharge of electrical energy from an energy storage capacitor into a load, such as an exploding foil initiator (EFI).

2. Description of the Prior Art

In a circuit for setting off an EFI, a high voltage switch is used to hold off the voltage on an energy storage capacitor (typically, 2–3 KV) and then, upon triggering, produce a fast rise time pulse to the EFI. Typical pulse characteristics include: stored energy of 0.3 to 0.6 Joules; rise time of 30–60 nsecs; peak current 3 to 7K amps; peak power 5 to 15M watts. The most commonly used switch for such applications is a ceramic body, hard brazed, miniature three electrode triggered spark gap, either gas filled or with an internal vacuum. Such devices have proven to be expensive and have exhibited unacceptable reliability.

Another switch known to be in use is an explosively initiated shock conduction switch. Such switches are provided with a primary explosive detonator which presents handling problems and can produce chemical contamination and, in some instances, explosive damage to surrounding electronics. This type of switch is a one-shot device.

There is a need for a relatively low-cost triggering switch which is reliable over an extended period of time, does not produce contamination, and is not self-destructive of circuit components.

SUMMARY OF THE INVENTION

It is, therefore, an object of the invention to provide a high voltage electronic switch for triggering firing of munitions, which switch is relatively inexpensive, reliable, and affords acceptable longevity.

A further object is to provide such a switch for controlling the discharge of electrical energy from an energy storage capacitor into an EFI.

A still further object is to provide such a switch having a two electrode hermetically sealed spark gap (such as a low cost: transient suppressor) and a second unsealed open close-spaced spark gap ("microgap"), the two electrode, sealed spark gap being used to stand-off the voltage from the energy storage and the "microgap", being used to facilitate triggering. Conduction to the EFI is initiated by a trigger voltage across the sealed spark gap and the microgap.

With the above and other objects in view, as will hereinafter appear, a feature of the present invention is the provision of an electronic switch for triggering firing of munitions, the switch comprising an electrical circuit having a high voltage source, a sealed two electrode gap in communication with the high voltage source, a microgap in series with the sealed gap, an exploding foil initiator in communication with the microgap, and an energy storage capacitor bridging legs of the circuit between the high voltage source and the sealed gap. A trigger circuit is in communication with the high voltage source and a fire pulse generator, and is provided with a lead extending from the trigger circuit to a circuit leg portion between the sealed gap and the microgap. The energy storage capacitor is charged by the high voltage source to a voltage V, which is substantially across the sealed gap. A pulse from the fire pulse generator activates the trigger circuit to provide a high voltage potential $V_t$ across the sealed gap, such that voltage $V+V_t$ breaks down the sealed gap to permit conduction therethrough. The microgap is thereby made subject to the pulse high voltage $V_t$ and the conduction of voltage V through the sealed gap, breaking down the microgap to permit flow of current to the exploding foil initiator.

The above and other features of the invention, including various novel details of construction and combinations of parts, will now be more particularly described with reference to the accompanying drawings and pointed out in the claims. It will be Understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
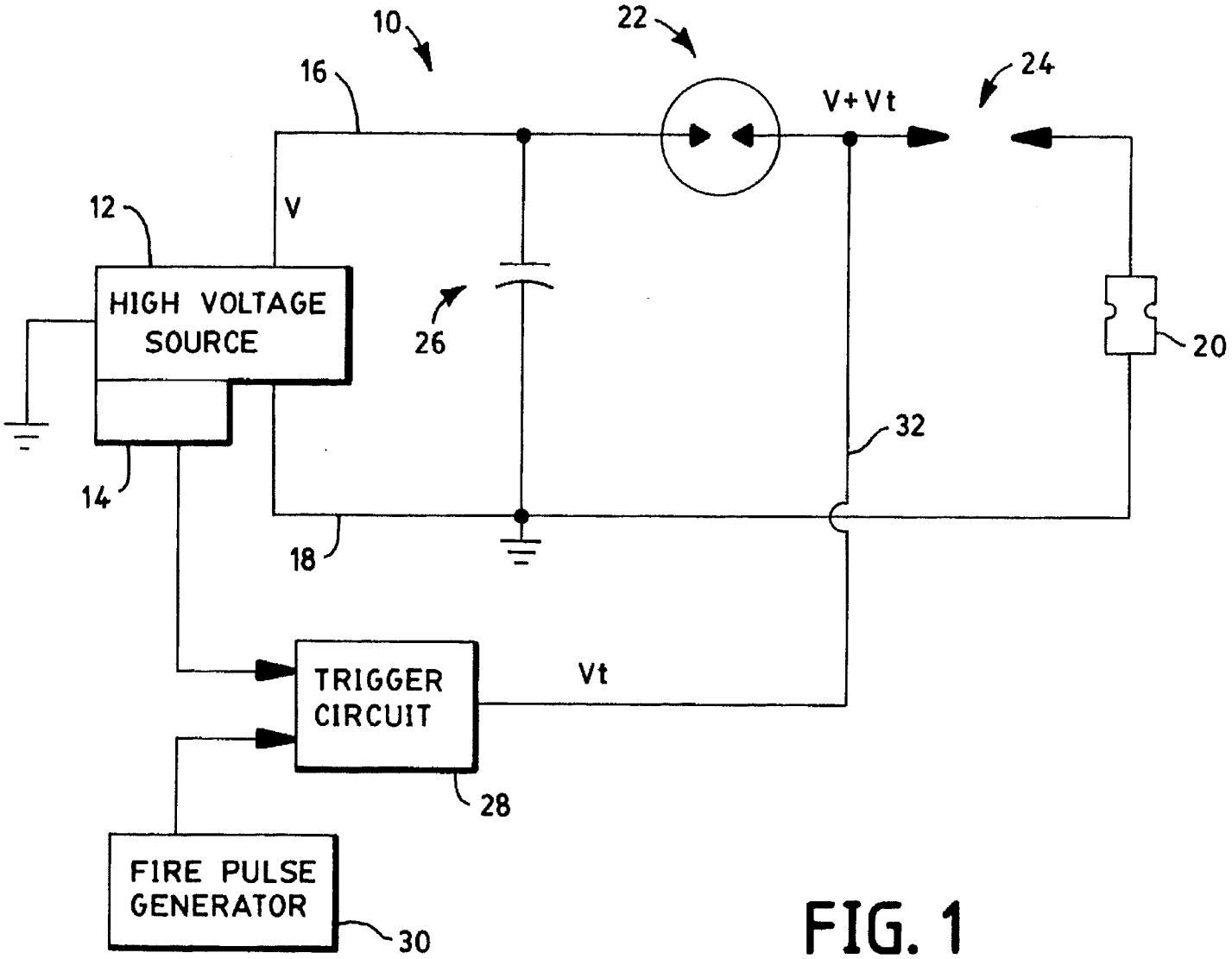
FIG. 1 is a schematic diagram of one form of switch illustrative of an embodiment of the invention.

Referring to FIG. 1, it will be seen that the illustrative switch comprises an electrical circuit 10 including a high voltage source 12, which may include a trigger voltage source 14. Alternatively, the trigger voltage source 14 may be independent of the high voltage source 12.

For illustrative purposes, the circuit 10 is schematically depicted with first and second legs 16, 18 extending from the high voltage source 12 to the EFI 20. In the first leg 16 there is disposed a hermetically sealed two electrode spark gap 22 and an unsealed microgap 24, in series. An energy storage capacitor 26 bridges the legs 16, 18 between the high energy source 12 and the sealed spark gap 22 and between the high energy source 12 and the EFI 20, respectively. A trigger circuit 28 is in communication with the high voltage source 12, or the trigger voltage source 14, and a fire pulse generator 30.

The energy storage capacitor 26 is charged by the high voltage source 12 to a high voltage V, about 2–3 KV, which voltage is substantially across the sealed spark gap 22.

Upon activation of the fire pulse generator 30, an electrical pulse actuates the trigger circuit 28, which was previous charged by the trigger voltage source 14, and which outputs a high voltage pulse $V_r$. The trigger circuit 28 includes a lead 32 extending to the aforesaid first circuit leg 16, between the sealed spark gap 22 and the microgap 24. The potential across the sealed spark gap 22 is then the high voltage V from the energy storage capacitor 26 and the high voltage pulse $V_t$ from the trigger circuit 28, that is, voltage $V+V_t$. The combination of voltage $V+V_t$ breaks down the sealed spark gap 22. The trigger pulse voltage $V_t$ is also across the microgap 24 which also breaks down from the combination of the voltage $V_t$ from the trigger pulse and the voltage V through the sealed spark gap 22.

About 3,000–7,000 amps current through the sealed spark gap 22 and the microgap 24 flows through the EFI 20 which operates to explode a warhead, start a solid fuel engine, or the like.

The two electrode, hermetically sealed spark gap 22 may be any one of several types known in the art, including ceramic, brazed electrode; ceramic, soldered electrode; ceramic, planar gap; glass, metal electrode; or a planar gap in a hermetic integrated circuit package, such as an 8 pin, ceramic DIP. One known embodiment of sealed spark gap found acceptable is a CITEL brand 2 KV transient suppressor, two electrode hermetically sealed spark gap.

The microgap 24 may be an open 0.02–0.04 inch spark gap with brass electrodes, or with copper electrodes as part of a printed circuit or "Kapton" flexprint assembly.

There is thus provided a high voltage switch which comprises two spark gaps, a primary gap 22, which is a hermetically sealed two electrode spark gap, and a secondary gap 24, which is an unsealed microgap. The primary and secondary gaps 22, 24 are in series. Stand-off of the system voltage V is nominally across only the sealed spark gap 22. Triggering is accomplished by applying a trigger pulse, or voltage $V_t$, across the gap 22 and microgap 24. Together in series, because they breakdown from overvoltage, the primary and secondary gaps are about as efficient as a typical triggered sparkgap, but substantially less expensive, more reliable, and with similar or longer life expectancy.

Figure 2:
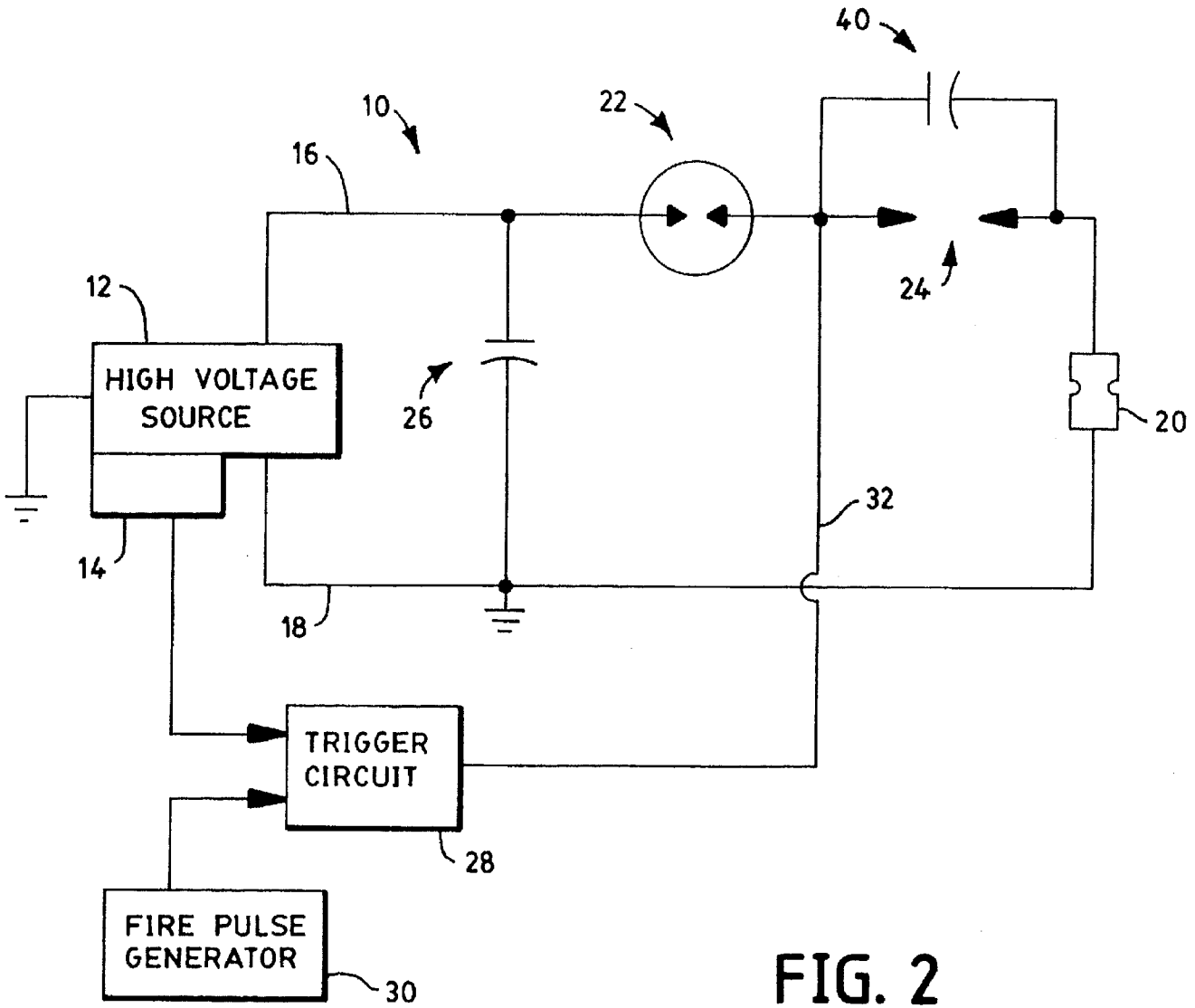
FIG. 2 is a schematic diagram, similar to FIG. 1, but illustrative of an alternative embodiment of the invention.

In FIG. 2, there is shown an alternative embodiment the same as the embodiment shown in FIG. 1, and described hereinabove, with the added feature of an additional capacitor 40 in parallel with the microgap 24 in the circuit first leg 16. Included to aid high level breakdown of the sealed spark gap 22, the capacitor 40 provides a low impedance discharge path across the microgap 24 at the start of triggering (the microgap is also a very low impedance once it breaks down). The microgap electrode spacing is sufficient to sustain the trigger voltage $V_t$ for several microseconds in a worst case environment, such as at low pressure.

It is to be understood that the present invention is by no means limited to the particular construction herein disclosed and/or shown in the drawings, but also comprises any modifications or equivalents within the scope of the claims.

Having thus described our invention, what we claim as new and desire to secure by Letters Patent of the United States is:

1. An electronic switch for triggering firing of munitions, said switch comprising an electrical circuit comprising:

a high voltage source;

a sealed two electrode gap in communication with said high voltage source;

an unsealed microgap directly in series with said sealed gap;

an initiator in communication with said unsealed microgap;

an energy storage capacitor that bridges legs of said circuit between said high voltage source and said sealed gap;

a trigger circuit in communication with said high voltage source and a fire pulse generator; and a lead extending from said trigger circuit to one of said legs of said circuit between said sealed gap and said unsealed microgap;

whereby said energy storage capacitor is charged by said high voltage source to a voltage V which is across said sealed gap, and a pulse from said fire pulse generator activates said trigger circuit to provide a high voltage potential $V_t$ across said sealed gap, such that voltage $V+V_t$ breaks down said sealed gap to permit conduction therethrough, said unsealed microgap being subject to said pulse high voltage potential $V_t$ and said conduction through said sealed gap, thereby breaking down said unsealed microgap substantially simultaneously with breakdown of said sealed gap to permit flow of current to said initiator.

2. The switch in accordance with claim 1 wherein said circuit further includes a trigger voltage source.

3. The switch in accordance with claim 2 wherein said high voltage source includes said trigger voltage source.

4. The switch in accordance with claim 2 wherein said trigger voltage source is discrete from said high voltage source.

5. The switch in accordance with claim 2 wherein said two electrode gap is hermetically sealed.

6. The switch in accordance with claim 5 wherein said energy storage capacitor is charged by said high voltage source to about 2–3 KV.

7. The switch in accordance with claim 6 wherein said unsealed microgap is provided with a 0.02–0.04 inch spark gap.

8. The switch in accordance with claim 1 wherein said sealed two electrode gap stands-off voltage from said energy storage capacitor.

9. The switch in accordance with claim 8 wherein said energy storage capacitor is charged by said high voltage source to about 2–3 KV.

10. The switch in accordance with claim 1 wherein said circuit further comprises a second capacitor in parallel with said unsealed microgap in said one leg of said circuit between said sealed gap and said initiator.

11. An electronic switch for triggering firing of munitions, comprising:

a sealed two electrode gap;

an unsealed microgap directly in series with said sealed gap;

an initiator in communication with said unsealed microgap;

an energy storage capacitor that bridges legs of a circuit between a high voltage source and said sealed gap;

a lead extending from a trigger circuit to one of said legs of said circuit between said sealed gap and said unsealed microgap;

whereby said energy storage capacitor is charged by said high voltage source to a voltage V which is across said sealed gap, and a pulse from a fire pulse generator activates said trigger circuit to provide a high voltage potential $V_t$ across said sealed gap, such that voltage $V+V_t$ breaks down said sealed gap to permit conduction therethrough, said unsealed microgap being subject to said pulse high voltage potential $V_t$ and said conduction through said sealed gap, thereby breaking down said unsealed microgap substantially simultaneously with breakdown of said sealed gap to permit flow of current to said initiator.

* * * * *